United States Patent [19]

Best et al.

[11] 4,301,667

[45] Nov. 24, 1981

[54] TUBULAR LATCH BOLT RETRACTING MECHANISM

[75] Inventors: Walter E. Best; William R. Foshee, both of Indianapolis, Ind.

[73] Assignee: Best Lock Corporation, Indianapolis, Ind.

[21] Appl. No.: 146,791

[22] Filed: May 5, 1980

[51] Int. Cl.[3] ..... E05B 17/04

[52] U.S. Cl. ..... 70/380; 292/169.15; 292/169.17

[58] Field of Search ..... 70/380, 379 R, 379 A; 292/169.15, 169.17, 169.19

[56] References Cited

U.S. PATENT DOCUMENTS

| | | | |
|---|---|---|---|
| 2,447,190 | 8/1948 | Lickteig | 292/169.17 |
| 2,533,023 | 12/1950 | Lickteig | 292/169.15 |
| 3,206,959 | 9/1965 | Best . | |

OTHER PUBLICATIONS

Best "4 T" Tubular Latch Assembly, drawings A-774, A-786, A-6702, and A-36.

Best "4Ton" Night Latch Assembly, drawings A-787, A-6703, A-5396, A-6761 to, A-6766.

Schlarge "B" Lock shown by Catalog pp. B-3 and B-18 and side elevation sketch.

*Primary Examiner*—Robert L. Wolfe

*Attorney, Agent, or Firm*—Jenkins, Coffey, Hyland, Badger & Conard

[57] ABSTRACT

Retracting mechanism for a deadlocking latch bolt comprises a U-shaped frame extension for the latch bolt tube, having parallel side walls joined at the rear by an integral rear wall and held spaced at the front by outturned tabs engaged in the tube and riveted to its end wall by spring guide pins. A two-piece rotatable retractor is trapped between the side walls with its hub ends rotatable in bushings in such walls, and has a pair of arms axially separated by a central cylindrical section. The latch bolt tailpiece has a wide rear yoke portion formed by spaced parallel side legs which straddle and are guided by such central cylindrical section. One such leg carries a cross pin drivingly engaged in the slots of the retractor arms which swing 80° to retract the tailpiece through a long stroke. The rear yoke has forward stop shoulders which engage a stop face on the latch bolt tube to position the tailpiece for a full retraction stroke.

8 Claims, 7 Drawing Figures

TUBULAR LATCH BOLT RETRACTING MECHANISM

This invention relates to tubular lock mechanism, and especially to operating mechanism for the latch bolt of a tubular lock. Tubular locks are well-known, and include a latch tube mounted in a bore in the edge of a door and containing a latch bolt, with or without an auxiliary latch bolt which, when held retracted by a strike, causes the main latch bolt to be deadlocked. A rearward extension on the latch tube extends into a cross bore in the door and contains a rotary retractor connected to operate a tailpiece of the latch bolt and arranged to be operated by a spindle extending axially of the cross bore. The spindle is normally connected for rotation by the key plug of a key-actuated cylinder mounted on the outside face of the door and may be connected for operation from inside the door either by a smilar key-actuated cylinder or by a turnknob mounted on the inside face of the door.

In some prior tubular locks, the latch tube is not symmetrical about its axis and hence not rotatable to suit doors of different hand. In some, the edge bore containing the latch tube is not coplanar with the cross bore which locates the key-actuated cylinder and contains the operating spindle, which complicates mounting. Also, the retractor mechanisms of some locks have only a limited throw and require a latch bolt mechanism which includes a throw multiplier.

The present invention relates to the construction and arrangement of the latch tube extension, the tailpiece, and the rotary retractor and their relationship with each other and with the latch mechanism. The present invention may be used with any of a number of latch mechanisms, with or without a deadlocking auxiliary latch, but is especially adapted for use with the deadlocking latch bolt mechanism of our co-pending application (Ser. No. 146,670, filed Mar. 5, 1980), in which the latch bolt is connected for direct movement with the tailpiece, through a full throw equal to the retractor throw and with substantially no lost motion therebetween and without a throw "multiplier".

It is the general object of the invention to provide an improved latch bolt operating mechanism which will be of simple and economical construction, easy to make and assemble, and adapted for easy and reliable operation over a long service life. A further object is to provide a latch tube which is symmetrical about its axis and adapted to be mounted in an edge bore coplanar with the cylinder cross bore and to be differently oriented therein to suit doors of different hand.

A further object is to provide such a symmetrical retractor and tailpiece mechanism which provides a relatively long and adequate throw for the tailpiece and its connected latch bolt and in which the rotary retractor and tailpiece are connected for concurrent movement with each other and with the latch bolt, in both directions, whether the lock is manually operated from a face of the door or the latch bolt is cammed to a retracted position by engagement with a strike. Still further objects will appear from the following description of a specific embodiment.

In accordance with the invention, the latch tube extension has two parallel side walls, preferably formed as the sides of a U-shaped member interconnected by an integral rear wall and having out-turned tabs at the front which are received within the latch tube and riveted to rear wall segments of that tube. A rotary retractor has end journals mounted in bearing openings in such side walls, preferably in low-friction bushings therein. The retractor includes a hub and at least one slotted radial arm which preferably lies adjacent a circular section of the hub, and preferably two such arms at opposite sides of a central cylindrical section. The tailpiece extends across the rotary retractor, and carries a cross pin engaged in the slot of the retractor arm. Preferably, the tailpiece has a wide rear yoke portion forming two parallel spaced legs which straddle the cylindrical section so as to be guided thereby, and the cross pin is fixed in one such leg. The retractor is preferably made in two axially separated parts, which are held axially together by being trapped between the side walls and held rotatively together by engagement of the cross pin with slotted arms on both parts.

The wide rear portion of the tailpiece desirably has at least one and preferably two forward-facing shoulders which engage against a rear stop face, desirably the rear face of a guide block in the latch tube, and the latch bolt is desirably biased forward by one or more springs which react against such guide block, so as to accurately position the tailpiece relative to the retractor. As more fully covered in our co-pending application, the guide block is desirably of C-shaped cross section with a wide guide slot and a narrower side entranceway, and the tailpiece has a narrowed front section adapted to pass through the entranceway and a wider rear portion to be guided in the guide slot.

The accompanying drawings illustrate the invention, anmd show a preferred embodiment exemplifying the best mode of carrying out the invention as presently contemplated. In such drawings.

Figure 4:
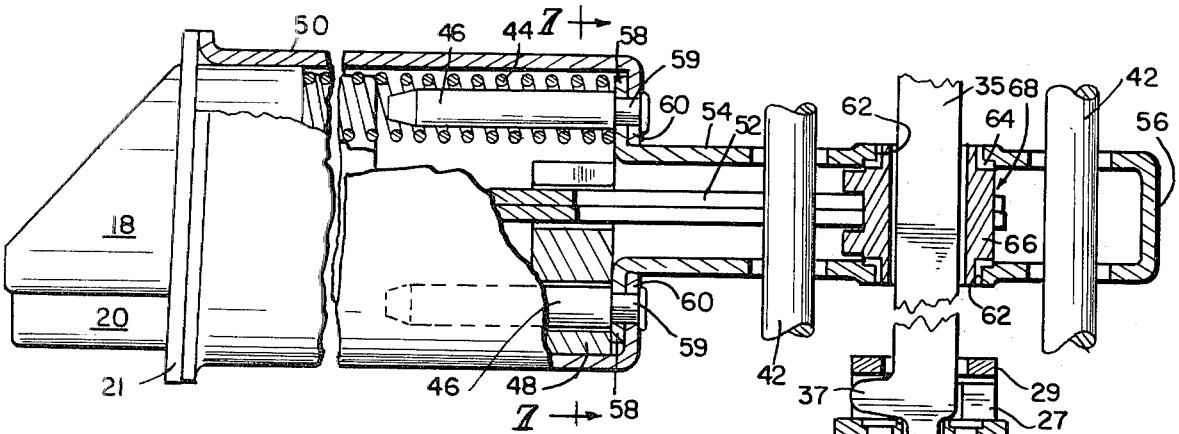
FIG. 4 is a sectional view generally in the same plane as FIG. 2, but on an enlarged scale and with parts shown in section.
Figure 5:
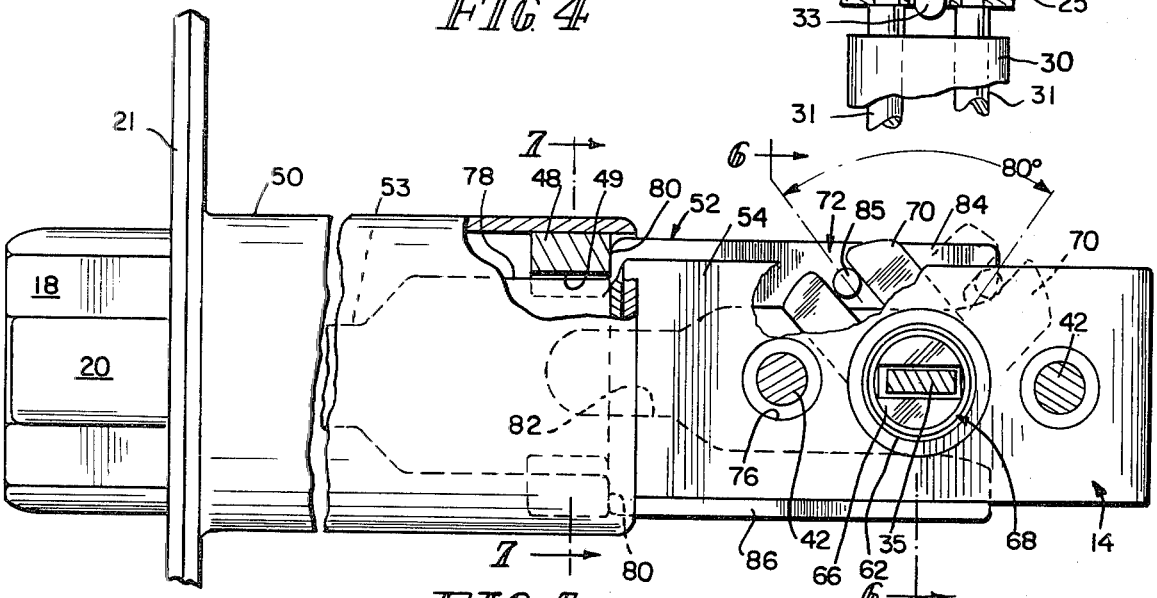
FIG. 5 is a side elevation of the latch tube and latch tube extension shown in FIG. 4.

The lock mechanism shown in the drawings comprises a latch tube assembly 10 mounted in a bore in the edge of a door 12 and having a rear extension 14 extending across the axis of a transverse bore 16 through the face of the door. The through-bore axis and the edge-bore axis lie in the same horizontal plane. Such assembly 10 comprises a housing tube 50 with a flat flange at its front end, to which a face plate 21 is riveted. A latch bolt 18 and an auxiliary bolt 20 are mounted in the housing tube and project from the edge of the door so as to engage a strike 22 mounted on the doorjamb. The outside face of the door carries a key-actuated lock cylinder 24 mounted in a cylinder ring 26 against a rose 28. The lock cylinder is desirably of the type which receives a key-removable core 30 having a rotatable key plug 32, as shown for example in U.S. Pat. No. 3,206,959. As shown, the inside face of the door carries a turnknob 34 mounted by its stem 36 in a rose 38 fixed against a support plate 40. A pair of bolts 42 extend through the turnknob rose assembly through the cross bore 16 and are threaded into the body of the cylinder 24, to secure the turnknob assembly and the cylinder assembly together and against the faces of the door. As shown in FIGS. 4 and 5, the bolts 42 lie in the plane of the two bore axes and extend through openings 76 in the extension 14 of the latch tube assembly. If desired, a key-actuated cylinder assembly like the assembly 24 on the outside face of the door may be mounted on the inside face instead of the turnknob assembly shown. Also, the latch tube assembly may contain a non-deadlocking latch bolt instead of the deadlocking latch bolt and auxiliary latchbolt as shown.

Figure 1:
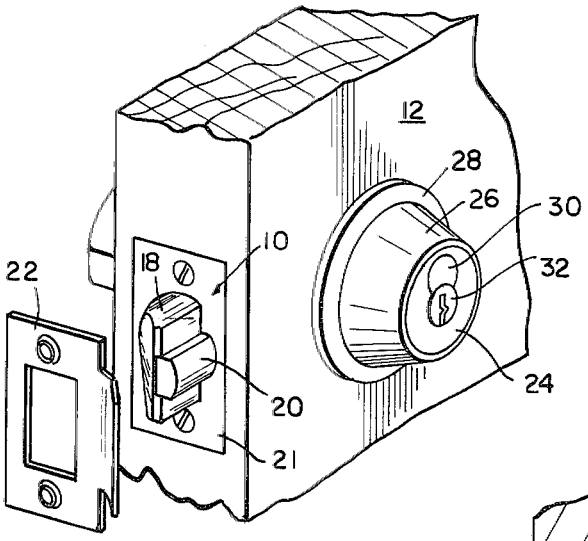
FIG. 1 is a perspective view of a tubular lock in accordance with the invention, mounted in a door and movable into engagement with a strike.
Figure 2:
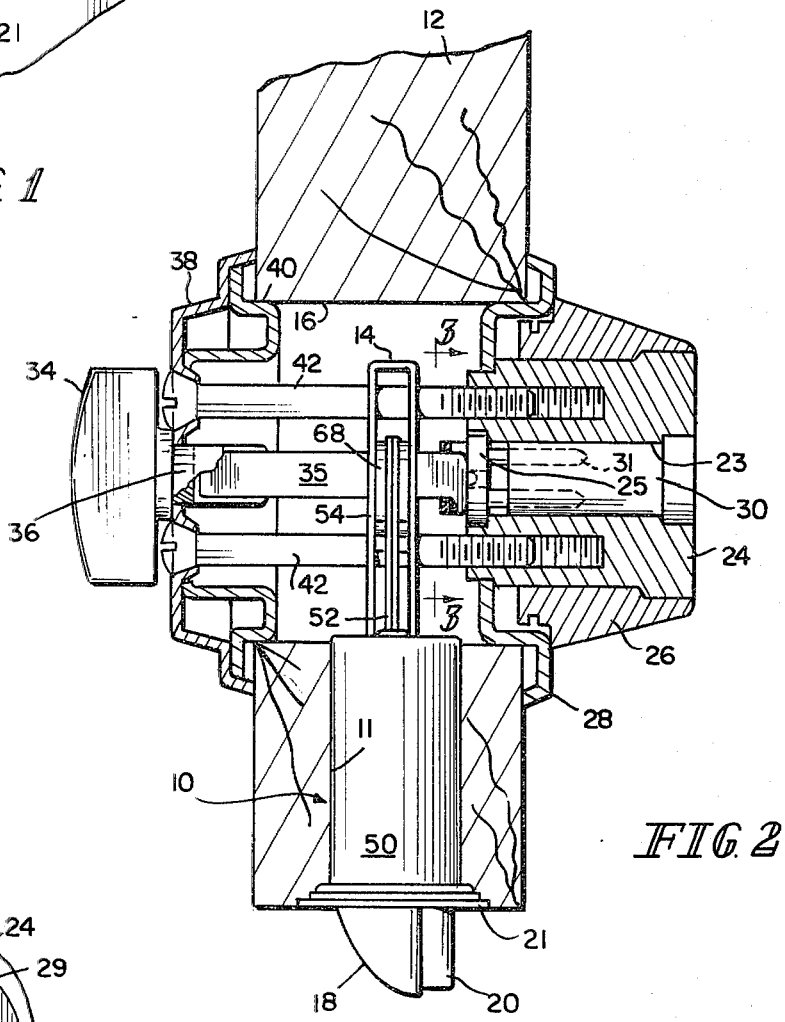
FIG. 2 is a horizontal sectional view of the tubular lock shown in FIG. 1, taken on the common plane of the axes of the latch tube and the lock cylinder.
Figure 3:
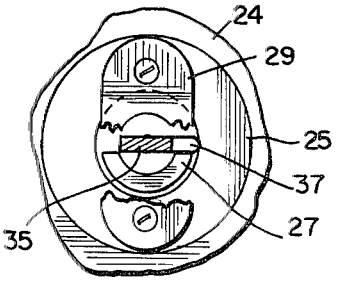
FIG. 3 is a partial section taken on the line 3—3 of FIG. 2.

The cylinder 24 forms a chamber 23 for the reception of the key-removable core 30, which chamber has a lower cylindrical portion coaxial with the key plug 32 and on the center line of the cylinder 24. A throw plug 25 is rotatably mounted in the rear wall of such cylindrical chamber portion and has forward extending pins 31 which take into corresponding holes in the rear of the key plug 32. The throw plug 25 is connected to the bolt-retracting mechanism by a spindle 35. As shown in FIGS. 3 and 4, the rear face of the throw plug 25 is formed with an arcuate boss 27 which extends through less than 180°, and the spindle 35 is a generally flat bar having a central nose 33 which is received in a central opening in the key plug 25 and having a laterally projecting finger 37 which projects across the end of the arcuate boss 27 on the throw plug 25. The end of the spindle 35 is held in engagement with the throw plug 25 by a retaining bracket 29 fixed to the rear face of the cylinder 24. The arrangement providesa full 180° of rotary lost motion of the spindle 35 with respect to the throw plug 25. The spindle finger 37 normally lies in a forward direction and above the boss 25 on the throw plug so that it can move in lost motion in the direction of retraction movement of the bolt retracting mechanism and thereby permit bolt retraction movement in response to inward thrust on the latch bolt, without transmitting motion to the locked key plug. The other end of the spindle is received in a diametric slot in the turn knob 34 substantially without lost motion and will transmit rotary motion to the turnknob from the spindle, as in response to inward thrust on the latch bolt.

As shown in FIG. 4, the latch bolt 18 is spring-pressed forward to its projected position by a spring 44 engaged over a guide pin 46 and bearing against an out-turned ear 58 of the rear extension 14 as described below. A second guide pin 46 is mounted diametrically opposite the first guide pin and extends through a guide block 48 mounted at the rear of the latch tube 50. Such second pin guides a spring (not shown) which biases the auxiliary bolt 20 to advanced position. The deadlocking mechanism controlled by that auxiliary bolt is not shown here, but is preferably as shown in my co-pending application referred to above. The latch bolt 18 is connected to a tailpiece 52 which may be made of two identical sheet metal stampings mounted in face-to-face relation. The tailpiece is connected to retract the latch bolt 18 with substantially no lost motion so as to produce a long bolt throw equivalent to the long tailpiece throw produced by the retractor of the present invention.

The latch tube extension 14, best seen in FIGS. 4 and 5, consists of a unitary strip of metal bent to U-shape with opposite side walls 54 interconnected at the rear by an integral transverse wall 56. The front ends of the side walls 54 carry outward bent tabs 58 which lie against the inside faces of opposite segments 60 of a rear wall in the latch tube 50. Such tabs 58 are secured in place by rivets 59 formed integral with the guide pins 46. The side walls 54 of the extension have retractor mounting openings 62, the edges of which are slightly offset to form seats for hub bushings 64 which receive end trunnions on the hub portion 66 of a rotary retractor 68. Such retractor may be made in two axial halves which are held together by engagement of their journal ends in the side walls. It carries two spaced radial arms 70 having aligned radial slots 72 which stand at opposite sides of a central cylindrical section 74 and are shaped to lie within the projected area of the tube 50 when in normal position. The retractor 68 is thus rotatably mounted in the side walls and trapped therebetween without the necessity for securing the halves together or for other mounting operations other than the riveting by which the extension 14 is attached to the latch tube 50. The side walls 54 of the extension 14 are also formed with holes 76 to pass the bolts 42. While the presence of such bolts limits the throw of the rotary retractor, the arrangement permits a throw of 80° and provides a long throw for the tailpiece, for example, the 9/16 inch throw of the latch tube of our co-pending application.

Figure 6:
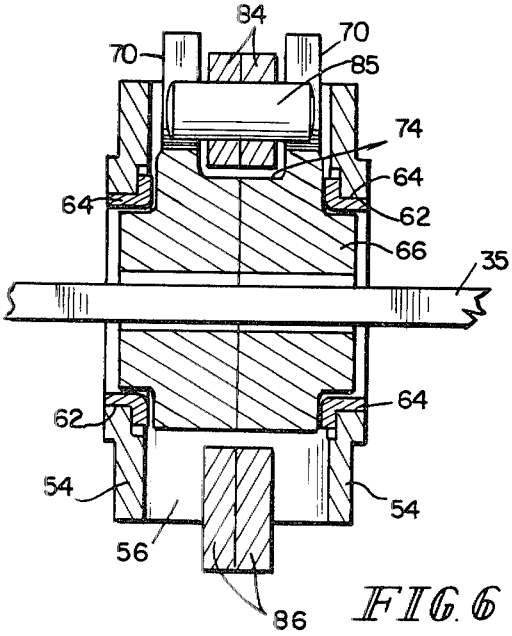
FIG. 6 is an enlarged sectional view on the line 6—6 of FIG. 5.
Figure 7:
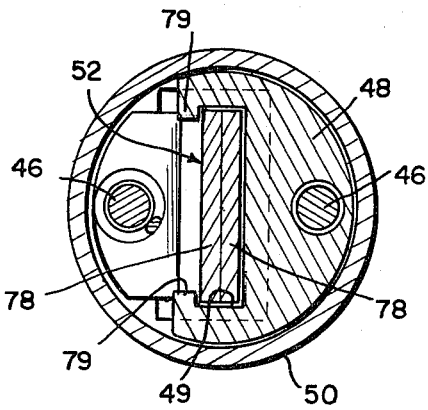
FIG. 7 is a section on the line 7—7 of FIGS. 4 and 5.

As is seen in FIG. 7, the guide block 48 is of generally C-shaped cross section and defines a guideway 49 adapted to receive a central straight section 78 of the tailpiece 52. The side opening of the C cross-section, between the in-turned ends 79, defines a lateral entranceway to the guideway. A forward portion 53 of the tailpiece is narrower than the side opening of the guide block, to admit the tailpiece therethrough to the guide slot. Behind the guide block 48, the tailpiece is wider than the guide slot 49 and presents shoulders 80 as stops against the rear face of the guide block 48. The wide rear portion of the tailpiece 52 forms a yoke with a central slot 82 to clear the bolts 42 and the central cylindrical section 74 of the retractor hub 66, and consists of two side legs 84 and 86 which straddle and embrace that central section 74 so as to guide the rear portion of the tailpiece for linear motion axially of the latch tube assembly. The upper leg 84 (as shown in FIGS. 5 and 6) lies between the two spaced arms 70 of the retractor 68 so as to be centered thereby between the side walls 54 of the latch tube extension. Such upper leg 84 carries a cross pin 85 which extends outward into the slots in the two retractor arms 70. The arrangement is therefore such that rotary motion of the retractor will cause linear movement of the tailpiece. The retractor arms 70 have a normal forward sloping position shown in full lines and toward the left in FIG. 5, and swing rearward to a rearward sloping position shown in dotted lines. Since the tailpiece 52 is biased forward by the spring 44 of the latch tube assembly, the retractor will normally lie in its forward sloping position shown in full lines in FIG. 5.

Because the cylindrical section 74 of the retractor hub 66 guides the straddle mounted tailpiece, the retractor axis can be close to the linear path of the cross pin 86 and can have a relatively long angular throw so as to produce a long tailpiece throw. In an exemplary embodiment as shown, in which the cross pin was nominally 0.326 inch from the latch tube center line, the retractor throw was approximately 80° and produced a tailpiece throw of 9/16 inch.

The spindle 35 extending between the lock cylinder on the outside face of the door and the turnknob 34 on the inside face of the door engages a diametric slot in each half of the hub 66 of the retractor, so that rotation of either the key plug 32 of the cylinder or the turnknob 34 will rotate that spindle and thereby rotate the retractor 68 to carry its arms 70 from their forward sloping position to their rearward sloping position as seen in FIG. 5. This will move the cross pin 85 linearly from its forward position to its rearward position shown in dotted lines and will thereby retract the tailpiece through a long full throw. This will retract the latch bolt 18 to open the door.

The mechanism facilitates assembly. The latch tube 50 and its rear extension 14 are assembled with the retractor between the side walls 52. The tailpiece 52 is assembled from its two laminations and the cross pin is press-fitted in place. The narrow tailpiece portion 53 is passed through the side opening of the guide block 48 into the guide slot 49 and the tailpiece is moved forward in that slot until its stop shoulders 80 engage the rear face of the block 48, as shown in FIG. 5. The bolt 18 is assembled to the front end of the tailpiece, where it is held against forward disengagement, and the spring 44 and other parts of the bolt mechanism are mounted between it and the guide block so as to form a substantially self-sustaining assembly, as more fully explained in our co-pending application. This assembly is then inserted into the open front end of the latch tube, with the rear yoke legs 84 and 86 oriented to pass through the rear opening in the latch tube 50 and between the side walls 54 of the rear extension, and into straddling relation with the central cylindrical portion 74 of the retractor 68. The retractor arms 70 are swung forward to cause the cross pin 85 to enter their radial slots 72, and the assembly is moved rearward until the guide block is seated against the rear of the latch tube. The front opening of the latch tube is then closed by the face plate 21 which is secured in place as by tubular rivets about the screw holes. The resulting assembly is mounted in the edge bore of the door with its axis coplanar with that of the core bore 16 and the lock mechanism therein.

Operation is as follows. The normal condition of the latch mechanism is as shown in full lines in the drawings. The latch bolts 18 and 20 project from the edge of the door in position to be locked to the strike in the usual manner. The rotary retractor 68 will be in its forward sloping position as shown in full lines in FIG. 5, with the spindle 35 extending through its diametric slot, and the tailpiece 52 will be advanced with its shoulders 80 stopped against the rear face of the guide block 48. In the forward sloping position of the retractor 68, its arms 70 will lie within the projected area of the latch tube 50 so as to permit ready insertion of that latch tube in the edge bore of the door.

When the door is unlocked by rotating either the turnknob 34 on the inside face of the door or by turning the key plug 32 with the use of a suitable key, the spindle 35 will be rotated in a direction to carry the retractor arms 70 from their forward sloping position shown in full lines in FIG. 5 to their rearward sloping position shown in dotted lines in FIG. 5. This will carry the cross pin 85 in the tailpiece rearward, and will produce rearward linear motion of the tailpiece 52 through its full retraction stroke. With the deadlocking mechanism shown in our co-pending application, there will be no lost motion between the retracting tailpiece and the latch bolt 18, so that the full length of throw of the cross pin 85 will be transmitted to the bolt 18. When the manual retraction force is released, the bolt-biasing spring 44 will drive the bolt 18 forward to its normally projected position, and this movement of the bolt 18 will carry the tailpiece 52 forward to its stop position against the guide block 48. The parts will then have returned to their normal position as shown in the drawings. When the door is closed, the latch bolt 18 will be cammed rearward by the strike, and will carry the auxiliary bolt 20 with it. When it comes into alignment with the opening of the strike, the latch bolt 18 will be projected through the opening, while the auxiliary latch bolt 20 will be held retracted, for purposes of deadlocking the latch bolt 18, in accordance with the known function of deadlocking latch bolt mechanisms. In these operations of the latch tube assembly, the tailpiece 52 will be guided for linear movement axially of the latch tube 50, both by the guide block 48 and by the engagement of the arms 84 and 86 on opposite sides of the cylindrical section 74 of the retractor hub 66.

The mechanism provides smooth, direct, positive, and easy operation of the latch bolt. The direct drive connection between the rotary retractor and the linearly movable tailpiece provides ample throw for a latch bolt of effective length. The mechanism is easily assembled in manufacture, and easily installed. The latch bolt assembly is symmetrical about a central axis, so that it can be mounted in either of two opposite orientations, either with the retractor arm at the top as shown in FIG. 5 or with the retractor arm at the bottom, for purposes of suiting doors of opposite hand. The latch bolt axis is in the same horizontal plane as the axis of the cross bore 16 and the cylinder 24 and turnknob 34, which facilitates installation of both in proper interrelationship in the door.

I claim:

1. Operating mechanism for a latch bolt mounted in a latch tube, biased to projected position and connected for retraction by a tailpiece, comprising an extension having spaced parallel side walls extending rearward from the latch tube, a rotary retractor having a hub rotatably mounted between said side walls and having at least one radially slotted arm and an adjacent cylindrical section, the tailpiece having a rear portion formed by spaced parallel side legs which straddle the cylindrical section of the retractor so as to guide the tailpiece for linear movement, and a cross pin mounted in one leg of the tailpiece and engaged in the slot of the retractor arm so as to cause rotary motion of the retractor to produce linear retraction of the tailpiece and retraction of the latch bolt.

2. Latch bolt operating mechanism as in claim 1 in which said extension is a U-shaped member having its side walls joined by an integral rear wall, the front ends of said side walls being joined to outward bent tabs secured against the inner faces of segments of a rear wall in the latch tube.

3. Latch bolt operating mechanism as in claim 2 in which the extension side walls have anti-friction bushings mounted in bearing openings therein and the retractor hub has end portions rotatably received in said bushings.

4. Latch bolt operating mechanism as in claim 1 in which said extension has side walls held in spaced relation, and said retractor hub is formed of two axially separated parts having outer journal ends received in bearings in said side walls, the two parts of the hub being thereby trapped together and journalled in the side walls.

5. Latch bolt operating mechanism as in claim 1 in which the retractor has two radially slotted arms axially separated by said cylindrical section, said one leg of the tailpiece lying between said two arms and the cross pin therein being engaged in the slots of both arms.

6. Latch bolt operating mechanism as in claim 5 in which the latch bolt is spring-pressed forward to projected position and is connected to thrust the tailpiece linearly rearward when the bolt is thrust rearward as by its camming engagement with a strike, the cross-pin and slot connection being operative to rotate the retractor rearward during such thrust-produced rearward linear movement of the tailpiece, the retractor being connected to a key-actuated cylinder lock through a lost motion connection which permits such thrust produced retractor rotation.

7. Latch operating mechanism as in claim 5 in which said tailpiece is a laminated assembly of at least two sheet metal stampings held together by said cross pin.

8. Operating mechanism for a latch bolt mounted in a latch tube, biased to projected position and connected for retraction by a tailpiece, comprising a U-shaped extension having spaced parallel side walls extending rearward from the latch tube and joined by an integral rear wall, said side walls having out-turned front tabs engaged against the inner face of rear wall segments in the latch tube, a rotary retractor having a hub with journal ends mounted for rotation in bearing openings in said side walls, and having a pair of radially slotted arms axially separated by a cylindrical section on said hub, said tailpiece having a rear portion formed by spaced legs which straddle and are guided by said cylindrical section, one leg being between the slotted arms, and a cross pin mounted in one leg of the tailpiece and engaged in the slots of said arms so as to cause rotary motion of the retractor to produce linear retraction of the tailpiece and vice versa.

* * * * *